US006104781A

United States Patent [19]

Buchmann

[11] Patent Number: 6,104,781

[45] Date of Patent: Aug. 15, 2000

[54] X-RAY GENERATOR FOR POWERING AN X-RAY TUBE COMPRISING AT LEAST TWO ELECTRON SOURCES

[75] Inventor: Franz Buchmann, Hamburg, Germany

[73] Assignee: U.S. Philips Corporation, New York, N.Y.

[21] Appl. No.: 08/120,982

[22] Filed: Sep. 13, 1993

[30] Foreign Application Priority Data

Sep. 16, 1992 [DE] Germany ..... 42 30 880

[51] Int. Cl.[7] ..... H05G 1/10

[52] U.S. Cl. ..... 378/101; 378/138; 378/109

[58] Field of Search ..... 378/134, 136, 378/138, 91, 92, 113, 101, 110, 112, 96, 108, 109, 111, 114, 117, 121

[56] References Cited

U.S. PATENT DOCUMENTS

| | | | |
|---|---|---|---|
| 2,160,605 | 5/1939 | Suits | 250/103 |
| 3,783,333 | 1/1974 | Atlee | 378/138 |
| 3,882,339 | 5/1975 | Rate, Jr. et al. | 313/60 |
| 4,065,689 | 12/1977 | Pleil | 313/56 |
| 4,160,906 | 7/1979 | Daniels et al. | 378/98 |
| 4,685,118 | 8/1987 | Furbee et al. | 378/114 |
| 4,995,069 | 2/1991 | Tanaka | 378/101 |
| 5,200,985 | 4/1993 | Miller | 378/101 |
| 5,303,281 | 4/1994 | Koller et al. | 378/134 |

FOREIGN PATENT DOCUMENTS

| | | |
|---|---|---|
| 1021512 | 12/1957 | Germany . |
| 2850583 | 6/1980 | Germany . |

*Primary Examiner*—David P. Porta
*Assistant Examiner*—Michael J. Schwartz
*Attorney, Agent, or Firm*—Dwight Renfrew

[57] ABSTRACT

An X-ray generator for powering an X-ray tube, has at least two electron sources for forming focal spots of different sizes at the same area of the anode. The resolution can be adapted to relevant requirements by associating each electron source with a respective control unit which produces an electron flow between the associated electron source and the anode, which flow is dependent on a control signal at a control input of the control unit, the two control units being activatable during an X-ray exposure and each control signal being adjustable, and hence also the ratio of the mAs products supplied by the electron sources.

8 Claims, 2 Drawing Sheets

X-RAY GENERATOR FOR POWERING AN X-RAY TUBE COMPRISING AT LEAST TWO ELECTRON SOURCES

BACKGROUND OF THE INVENTION

1. Field of the Invention

The invention relates to an X-ray generator for powering an X-ray tube which comprises at least two electron sources for forming focal spots of different size at the same area of the anode.

2. Description of the Related Art

X-ray tubes capable of forming two (or more) focal spots at the same area of the anode are known (DE-OS 28 50 583). The known X-ray generators for powering such X-ray tubes enable formation of X-ray images with either a small or a large focal spot. X-ray images formed using the smaller focal spot have a better resolution, whereas X-ray images formed using the larger focal spot require shorter exposure times because the larger focal spot can be loaded more and hence generates more X-rays. Therefore, for an X-ray exposure the operator must each time decide which of the two focal spots is to be used.

In practice, however, some X-ray images require a resolution which is higher than can be achieved by means of the large focal spot and an exposure time which is shorther than can be achieved by means of the small focal spot, i.e. a higher power. Such images could be formed by means of an X-ray tube which comprises at least one further electron source whose focal spot dimensions are between those of the large and the small focal spot. However, such X-ray tubes are complex.

Furthermore, from U.S. Pat. No. 3,882,339 it is known to vary the size of the focal spot in a grid-controlled X-ray tube by varying of the voltage at the control grid. However, thus far such X-ray tubes are available for low power only.

SUMMARY OF THE INVENTION

It is an object of the present invention to construct an X-ray generator for an X-ray tube of the kind set forth so that the resolution on the one hand and the power of the X-ray tube on the other hand can be adapted to the relevant requirements by simple means, that is to say independently of the voltage of the X-ray tube. On the basis of an X-ray generator and an X-ray tube of the kind set forth, this object is achieved in that with each electron source there is associated a respective control unit which produces an electron or current flow between the associated electron source and the anode, which flow is dependent on a control signal at a control input of the control unit, both control units being active and independently controllable during an X-ray exposure, the control signals being adjustable and hence also the ratio of the mAs products supplied by the electron sources.

The invention is based on the idea that the resolution of an X-ray tube is decided not only by the dimensions of the focal spot wherefrom the X-rays are emitted, but to a substantial extent also by the spatial distribution of the radiation or emission density in the respective active focal spot. It can be demonstrated that an increase of the radiation intensity or the electron density in a small part of the focal spot results in increased resolution in the image, notably when this part is situated at the center of the focal spot. This means that an X-ray image formed with such an electron density distribution in the focal spot has a modulation transfer function which corresponds to that of an X-ray image formed with a focal spot with a uniform electron distribution and smaller outer dimensions.

In accordance with the invention, the electron sources are operated by the control units so that the various focal spots are effective with a different weight during an X-ray exposure, in conformity with the mAs product (to be understood to mean the time integral over the current flowing between the electron source and the anode during an X-ray exposure) with which they contribute to the exposure. A ratio of mAs products supplied by the two electron sources is adjustable over a range of values including non-zero finite values (i.e. values where mAs product supplied by each source is non-zero). The more effective the larger focal spot in an X-ray tube comprising two focal spots, the smaller the resolution will be, but the higher the tube power available for the X-ray exposure will be. As a result of such different weighting of the focal spots, X-ray images can be formed which correspond, in respect of tube power and modulation transfer function, to the images formed by means of an X-ray tube whose focal spot (with uniform electron distribution) can be varied in respect of outer dimensions in the range between the small and the large focal spot.

It is to be noted that an X-ray generator for powering an X-ray tube with two focal spots of different size at the same area of the anode is already known from U.S. Pat. No. 2,160,605. Therein, the object is to activate that one of the filaments associated with the two focal spots which is compatible with the predetermined exposure parameters. To this end, the two filaments in parallel branches with non-linear or frequency-dependent impedances are powered by a common supply source so that as the supply voltage increases, first the filament current emitted by the filament for the smaller focal spot increases and abruptly or continuously decreases when a maximum value is reached. In the presence of small supply voltages the filament for the larger focal spot at first does not produce a current. It is only when the current for the smaller focal spot decreases again that the current starts to increase as a function of the supply voltage, that is to say either abruptly or continuously.

In the case of a continuous transition the two filaments can simultaneously supply an emission current. However, it has not been recognized that the resolution of this focal spot combination can be better than that of the larger focal spot and this effect could not be utilized either to vary the resolution and the power because the supply voltage for the filaments defined the ratio of the emission currents from the filaments (and hence the resolution) as well as the sum of the emission currents (and hence the power).

Furthermore, from U.S. Pat. No. 4,065,689 there is known an X-ray generator for powering an X-ray tube with two equally large focal spots which partly overlap. The emission currents for the two focal spots are adjustable. The object is to achieve a particularly attractive intensity characteristic, i.e. an essentially uniform intensity in the focal spot. The same holds for the prior art cited therein, where a larger and a smaller focal spot are superposed so that a uniform electron distribution is obtained (the electron density at the centre of a focal spot can often be smaller than at its edges).

According to the invention, the ratio of the mAs products supplied by the electron sources, i.e. the weight of the focal spots during an X-ray exposure, can be adjusted in various ways. In accordance with one version of the invention, the control units are simultaneously active during an X-ray exposure. In the simplest case the two electron sources simultaneously supply currents which are constant during the X-ray exposure. In accordance with a further version of the invention, the control units are consecutively active during an exposure. If sufficiently fast control of the electron sources by the control unit were achieved (for example, by means of a grid), a single control unit which consecutively controls the electron sources during an exposure would suffice.

A preferred embodiment of the invention includes a memory in which different combinations of control signals for the control units are stored for X-ray exposures with different exposure parameters, for an X-ray exposure the combination of control signals associated with the respective predetermined exposure parameters being fetched. This enables control of the electron sources by the control units during X-ray exposures with arbitrarily presettable exposure parameters so that always the optimum combination of modulation transfer function and tube power is obtained.

BRIEF DESCRIPTION OF THE DRAWING

The invention will be described in detail hereinafter with reference to drawing wherein.

DETAILED DESCRIPTION OF THE PREFERRED EMBODIMENT

Figure 1:
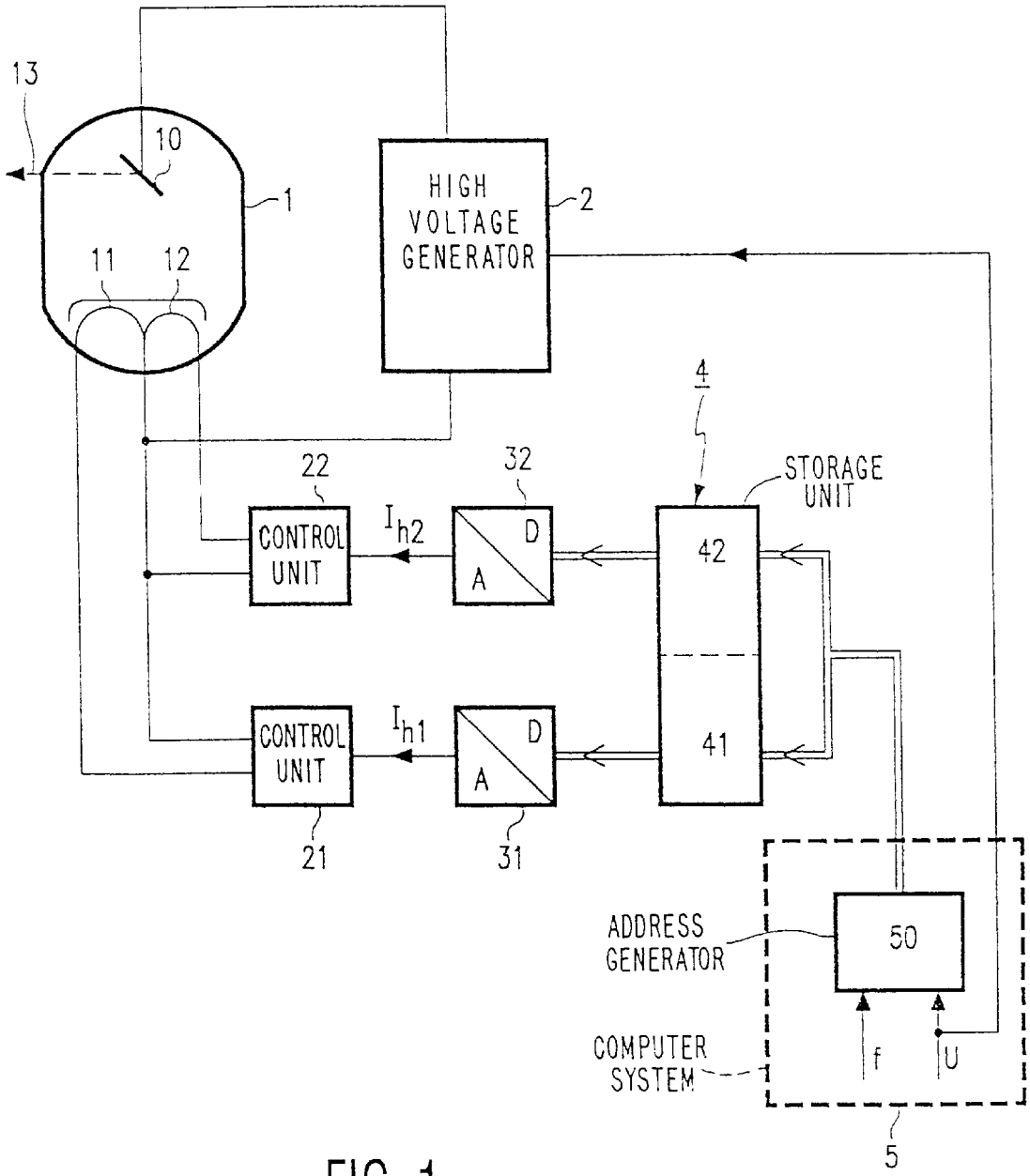
FIG. 1 shows a block diagram of the X-ray generator in accordance with the invention, including an X-ray tube having an anode.

The FIG. 1 shows a high-voltage generator 2 which powers an X-ray tube 1 and which supplies a positive high voltage for the anode 10 and a negative high voltage for the cathode (both with respect to ground) in the event of an X-ray exposure. The high voltage generated by the high-voltage generator 2 is adjustable by way of a signal U at its control input.

Figure 2:
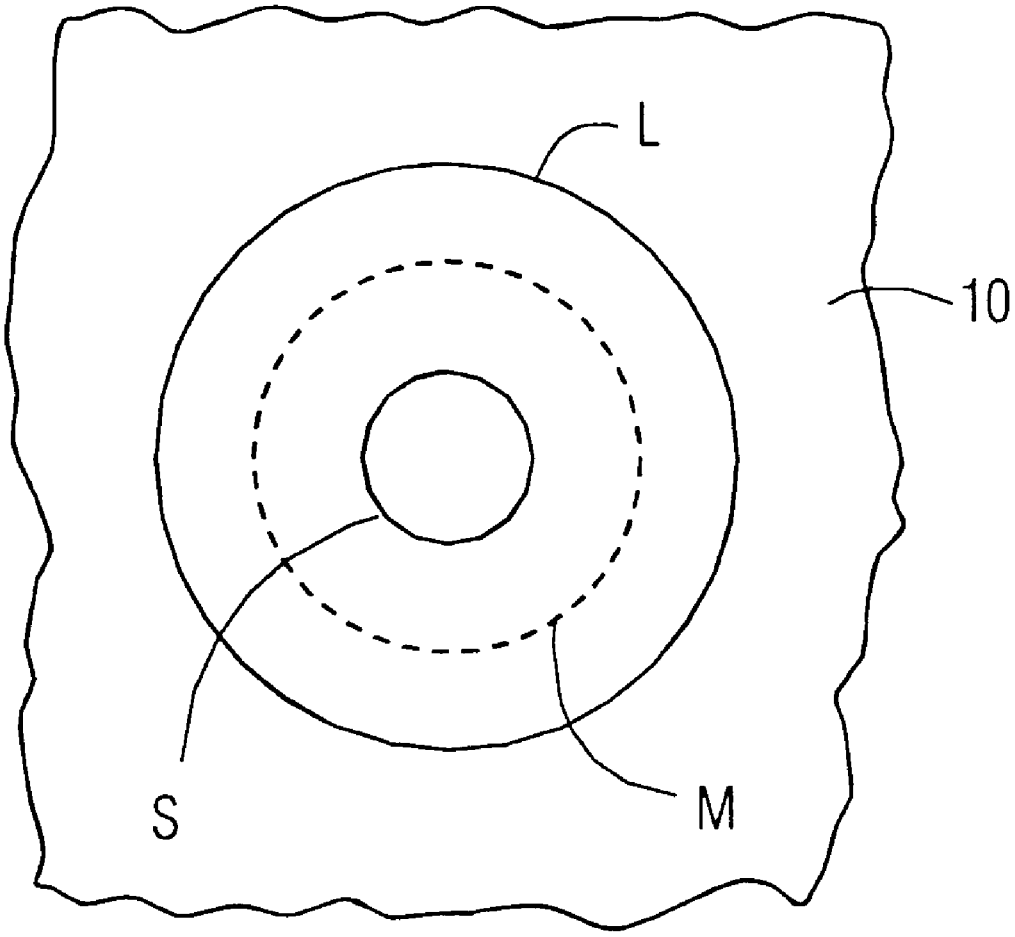
FIG. 2 shows focal spots on the anode of the X-ray tube in FIG. 1.

The cathode comprises two electron sources 11 and 12, for example two filaments which emit an electron flow when they are heated by a respective filament current. As shown in FIG. 2, the electron flows supplied by the electron sources are incident at a given area of the anode 10, thus defining respective large and small focal spots L and S thereon. The small focal spots is entirely encompassed by the large focal spot L. In particular, the focal spots are concentric, i.e. the small focal spots presumably generated by the electron source 12 is situated at the center of the large focal spot L (produced by the electron source 11). Viewed from the direction of emergence of the radiation, denoted by the dashed arrow 13, the focal spots are rectangular. X-ray tubes of this kind are generally known and described, for example in DE-OS 28 50 583.

It is assumed that the large focal spot L produced by the electron source 11 is a 1.1 mm focal spot (i.e., it is dimensioned 1.1 mm*1.1 mm, viewed from the direction of emergence of the radiation), and that the small focal spots is a 0.4 mm focal spot. The ratio of the focal spot sizes should not be substantially larger, because otherwise the modulation transfer function can be influenced only comparatively little by the weighting of the focal spots.

In a typical X-ray tube the highest permissible value of the electron flow supplied by the electron source 11 may amount to 1000 mA in the event of a tube voltage of 80 kV, and that of the flow supplied by the electron source 12 to 230 mA.

When the electron source 11 is switched off, the electron source 12 can deliver its maximum flow of 230 mA. The resolution then necessarily corresponds to the resolution of the smaller focal spot, i.e. of a 0.4 mm focal spot with uniform electron density. The tube power then amounts to approximately 18.4 kW.

However, when instead the flow supplied by the electron source 11 amounts to 10% of the permissible maximum value, i.e. 100 mA, the electron flow supplied by the electron source 12 should be reduced slightly (to approximately 200 mA) in order to prevent overheating of the anode. Even though the superposed focal spot thus formed has the outer dimensions of the larger focal spot (1.1 mm), it has a modulation transfer function which corresponds approximately to that of a 0.5 mm focal spot with a uniform electron density. The effective magnitude (relative to the modulation transfer function) of the superposed focal spot would thus be 0.5 mm. The tube power then amounts to approximately 26 kW.

When the flow supplied by the electron source 11 is increased to 300 mA, the flow supplied by the electron source 12 must be further reduced so as to avoid overloading of the anode, for example to 175 mA. The modulation transfer function of this focal spot, having an increased electron density at its centre, then corresponds approximately to that of a 0.6 mm focal spot with uniform electron density. The tube power amounts to 38 kW.

When the flow from the electron source 11 is increased to 500 mA and the flow from the electron source 12 is at the same time decreased to 125 mA, a focal spot is obtained whose modulation transfer function corresponds to that of a 0.8 mm focal spot with a uniform electron distribution. For the said tube voltage of 80 kV, the tube power then already amounts to 50 kW.

In the case of a tube voltage higher or lower than 80 kV, the flows supplied by the electron sources must be larger or smaller in conformity with the loadability of the X-ray tube. However, in the case of low tube voltages (for example, 40 kV), the values of the flows which are permissible in view of loadability will not be reached because of space charge effects.

The heating currents which determine the temperature of the electron sources 11 and 12 and hence the flows emitted thereby are supplied by a respective control unit 21, 22. Each of these control units comprises (not shown) a filament current transformer whose primary and secondary windings are isolated from one another so that the primary winding can carry ground potenital while the secondary winding carries a negative high voltage. Moreover, each of the control units comprises a control circuit which ensures that the filament current supplied to the electron sources 11 and 12 by the control units 21 and 22, respectively, is proportional to the control signal $I_{h1}$ and $I_{h2}$, respectively, at the control inputs of these units. The control signals $I_{h1}$ and $I_{h2}$ thus also determine the electron flow between the electron sources 11 and 12 on the one side and the anode 10 on the other side.

The control signals $I_{h1}$ and $I_{h2}$ are applied to the control units 21 and 22, respectively, via respective digital-to-analog converters 31 and 32. The inputs of these analog-to-digital converters are connected to a storage unit 4 wherefrom the control signals $I_{h1}$ and $I_{h2}$ are read (in digital form) in dependence on predetermined parameters of the X-ray exposure. For each electron source 11, 12 the storage unit 4 comprises a storage section 41, 42. For various voltages across the X-ray tube, in each of these storage sections, there are stored the control signals $I_{h1}$ and $I_{h2}$ which result in different flows from the electron sources as explained above for a tube voltage of 80 kV. The addresses at which the control signals are stored are supplied by an address generator 50 which may form part of a computer system (5) which also controls all other functions of the X-ray generator.

The address generator 50 may be constructed so that, after presetting of the effective size f of the focal spot (leading to the desired resolution in the presence of a uniform electron distribution) and the voltage U across the X-ray tube, it fetches the filament current values $I_{h1}$ and $I_{h2}$ producing the currents between the cathode and the anode of the X-ray tube 1 which are associated with this combination of U and f. For example, when a value f=0.6 mm and U=80 kV are preset, the control signals $I_{h1}$ and $I_{h2}$ for which the electron source 11 supplies a flow of 300 mA and the electron source 12 supplies a flow of 175 mA are fetched from the storage sections 41 and 42. The tube power then has the highest value with which the X-ray tube 1 can be operated for the predetermined modulation transfer function.

Evidently, instead of the effective focal spot size another exposure parameter can also be preset, for example the geometrical lack of focus which depends not only on the size f of the focal spot but also on the distances between X-ray source and film as well as between X-ray source and object to be imaged. The latter two quantities can be determined, if necessary, by a separate measuring device.

However, other exposure parameters can also be preset, for example the tube voltage, the longest exposure time that can be tolerated in view of motional unsharpness, and the mAs product of the flows supplied by the two electron sources. For example, when the tube voltage is 80 kV, the permissible exposure time is 100 ms and the mAs product is 62.5 mAs, for the permissible exposure time a flow of 625 mA follows therefrom, which flow is composed of 125 mA from the electron source 12 and 500 mA from the electron source 11. The resultant exposure then has a modulation transfer function which corresponds to that of an X-ray exposure with a 0.8 mm focal spot with uniform electron distribution. X-ray images obtained under these circumstances thus have the optimum resolution with a tube power which is still sufficient to execute an X-ray exposure with the preset exposure parameters within the preset permissible exposure time.

It has been assumed thus far that the filament currents, or the anode current resulting therefrom, are constant during the exposure. In order to avoid thermal overloading of the X-ray tube in the case of X-ray exposures with a long exposure time, however, it may be effective to decrease the flows supplied by the electron sources simultaneously in accordance with a given time function. A suitable variation in time could be simply implemented by utilizing multiplying analog-to-digital converters 31, 32 which receive, in addition to the digital values from the storage sections 41 and 42, a respective multiplication signal exhibiting a suitable variation in time so that the quotient of the flows supplied by the electron sources 11 and 12, and hence the modulation transfer function, remains constant during the exposure.

Instead of operating the X-ray tube with a ratio of the flows supplied by the electron sources 11 and 12 which is constant for each respective exposure, it is alternatively possible to vary these flows during an exposure as a function of time so that the flow from the electron source (12) associated with the smaller focal spots decreases from a maximum value as a function of time whereas the flow supplied by the other electron source (11) associated with the large focal spot L increases at least between given time limits, so that the resolution of the X-ray exposure is higher in the event of a short exposure time than in the case of a long exposure time. The necessary variations in time of the two control signals can then be stored as series of digital data words in the storage sections 41 and 42. The optimum resolution for the relevant exposure parameters would then be obtained.

It has been assumed that thus far the control units 21 and 22 control the electron sources 11 and 12 by varying their filament currents. However, when the X-ray tube comprises separately controllable grids, the filament currents of the electron sources can be kept constant and instead the grid bias voltages can be varied in the desired manner.

In the case of an X-ray tube having the indicated focal spot dimensions, the difference between the resultant modulation transfer function and the modulation transfer function of the larger focal spot is no longer essential when the flow supplied by the electron source 11 is greater than 500 mA, i.e. approximately 50% of the maximum flow of this electron source, so that continuous variation is possible only in the range of from 0 to 50% of the maximum flow. When the modulation transfer function is to be varied in a wider range, preferably a further electron source is used whose focal spot M is medium sized; i.e. it is is larger than the smaller and small focal spot S than the large focal spot L. When instead of the electron source for the smaller focal spot the further electron source is controlled accordingly, the modulation transfer function can be varied in an even wider range.

I claim:

1. An X-ray apparatus comprising an X-ray tube having an anode and two electron sources for forming respective focal spots of different size at a same area of the anode such that a larger one of said focal spots completely encompasses a smaller one of said focal spots, two control units having respective control inputs for receiving respective control signals, each control unit being associated with a different one of the electron sources and being means for controlling the associated electron source in order to produce an electron flow from the associated electron source to the anode dependent on a value of the respective control signal at the control input of the control unit, each of the control units being activatable and independently controllable during an X-ray exposure, and means for generating the control signals in a manner that a ratio of mAs products of electron flows from the two electron sources during an X-ray exposure is adjustable over a range of values, including non-zero finite values.

2. An X-ray apparatus as claimed in claim 1, wherein said control signals generating means comprises a memory in which different combinations of the respective values of the control signals are stored for X-ray exposures with different exposure parameters, and means for supplying a combination of values of control signals from said memory to the two control units, the supplied combination of values being associated with relevant preset exposure parameters.

3. An X-ray apparatus as claimed in claim 1, wherein the two control units are consecutively active during an X-ray exposure.

4. An X-ray apparatus comprising an X-ray tube having an anode and two electron sources for forming respective focal spots of different size at a same area of the anode such that a larger one of said focal spots completely encompasses a smaller one of said focal spots, two control units having respective control inputs for receiving respective control signals, each control unit being associated with a different one of the electron sources and being means for controlling the associated electron source in order to produce an electron flow from the associated electron source to the anode dependent on a value of the respective control signal at the control input of the control unit, said control units being simultaneously activatable and independently controllable during an X-ray exposure, and means for generating the control signals in a manner that a ratio of mAs products of simultaneous electron flows from the two electron sources during an X-ray exposure is adjustable over a range of values including non-zero finite values.

5. An X-ray apparatus as claimed in claim 4, wherein said control signals generating means comprises a memory in which different combinations of the respective values of the control signals are stored for X-ray exposures with different exposure parameters, and means for supplying a combination of values of control signals from said memory to the two control units, the supplied combination of values being associated with relevant preset exposure parameters.

6. An X-ray apparatus as claimed in claim 3, wherein the control signals generating means is configured for varying the control signals in time during an X-ray exposure.

7. An X-ray apparatus as claimed in claim 4, wherein the control signals generating means is configured for varying the control signals in time during an X-ray exposure.

8. An X-ray apparatus as claimed in claim 5, wherein the control signals generating means is configured for varying the control signals in time during an X-ray exposure.

* * * * *